US006062828A

United States Patent [19]

Townsend

[11] Patent Number: 6,062,828

[45] Date of Patent: May 16, 2000

[54] COMPRESSOR FOR LIQUEFIED GAS APPLICATIONS

[75] Inventor: Carl W. Townsend, Los Angeles, Calif.

[73] Assignee: Raytheon Company, Lexington, Mass.

[21] Appl. No.: 09/090,741

[22] Filed: Jun. 4, 1998

[51] Int. Cl.[7] ..... F04B 17/00

[52] U.S. Cl. ..... 417/397; 417/401

[58] Field of Search ..... 417/397, 401, 417/403

[56] References Cited

U.S. PATENT DOCUMENTS

| | | | |
|---|---|---|---|
| 2,938,465 | 5/1960 | Mcfarland et al. | 417/397 |
| 3,249,289 | 5/1966 | Maglott | 417/393 |
| 3,771,912 | 11/1973 | Conlee | 417/397 |
| 3,776,665 | 12/1973 | Dalton | 417/252 |
| 3,779,671 | 12/1973 | Lybecker et al. | 417/393 |

*Primary Examiner*—Henry Bennett
*Assistant Examiner*—Derek S. Boles
*Attorney, Agent, or Firm*—Colin M. Raufer; Leonard A. Alkov; Glenn H. Lenzen, Jr.

[57] ABSTRACT

A compressor that uses liquefied gas at high pressure as a hydraulic medium for compressing gas from low pressure to high pressure. The compressor comprises a central liquid cylinder and two gas cylinders disposed adjacent opposite ends of the liquid cylinder that are axially aligned therewith. A piston assembly is disposed within the cylinders that comprises a central liquid drive piston and two compression pistons that are free to slide within the respective liquid and gas cylinders. A low pressure gas manifold coupled to the piston assembly, and a liquid-gas manifold coupled to opposite ends of the piston assembly. A liquid switching valve having a first port comprising a high pressure liquid inlet, a second port coupled to an inlet of the central liquid cylinder, a third port coupled to an outlet of the central liquid cylinder, and a fourth port coupled to the liquid-gas manifold. Limit switches disposed at opposite ends of the piston assembly that are coupled to the liquid switching valve and cause the switching valve to rotate as a function of movement of the piston assembly.

12 Claims, 1 Drawing Sheet

COMPRESSOR FOR LIQUEFIED GAS APPLICATIONS

BACKGROUND

The present invention relates generally to compressors, and more particularly, to compressors for use in liquefied gas applications.

The assignee of the present invention manufactures carbon dioxide cleaning systems for use in cleaning garments, and the like. These carbon dioxide cleaning systems employ compressors that compress carbon dioxide gas from a low pressure to a high pressure that is used during cleaning.

Previously-used compressors have been powered by either a belt-driven crankshaft type assembly, or by a linear hydraulic pumping assembly. Both types of assemblies require a drive motor, and sliding seals which are subject to leakage or fluid contamination.

Accordingly, it is an objective of the present invention to provide for an improved compressor for use in liquefied gas applications.

SUMMARY OF THE INVENTION

To accomplish the above and other objectives, the present invention provides for a compressor that uses liquefied gas at high pressure as a hydraulic medium for compressing gas from low pressure to high pressure. A compressor using this principle requires no moving seals to isolate the working fluid from the environment.

More specifically, the compressor comprises a central liquid cylinder and two gas cylinders disposed adjacent opposite ends of the liquid cylinder that are axially aligned therewith. A piston assembly is disposed within the cylinders that comprises a central liquid drive piston and two compression pistons that are free to slide within the respective liquid and gas cylinders. A low pressure gas manifold is coupled to both ends of the compression cylinder assembly, and a liquid-gas manifold is coupled to opposite ends of the both ends of the compression cylinder assembly. A liquid switching valve having a first port comprising a high pressure liquid inlet, a second port coupled to an inlet of the central liquid cylinder, a third port coupled to an outlet of the central liquid cylinder, and a fourth port coupled to the liquid-gas manifold. Limit switches disposed at opposite ends of the piston assembly that are coupled to the liquid switching valve and cause the switching valve to rotate as a function of movement of the piston assembly.

The present invention eliminates the need for a separate hydraulic system for powering a compressor unit. By using a liquid of the same or similar composition, cross-contamination of fluids is eliminated. Fewer parts are needed, thus reducing the size and cost of compressor system. The sliding seals used in the present compressor are internally confined, thus preventing the possibility of external leakage, and also maintain fluid purity. The present invention also allows the compression process to be carried out at a lower temperature than other compressors, thus allowing lower cost seals and higher compression ratios. Additionally, the system can be used with gas streams in which the gas itself is thermally sensitive.

The present invention may be used with carbon dioxide cleaning systems such as those known as DryWash™, $CO_2$Clean™, and SuperScrub™ developed by the assignee of the present invention. Implementation of the present invention will reduce the cost of the machines used in the carbon dioxide cleaning systems. Other applications include cryogenic refrigeration systems for infrared sensor applications, and any application where high purity is needed.

BRIEF DESCRIPTION OF THE DRAWINGS

The various features and advantages of the present invention may be more readily understood with reference to the following detailed description taken in conjunction with the accompanying drawing, which illustrates a cross-sectional side view of a compressor for use in liquefied gas applications in accordance with the principles of the present invention.

DETAILED DESCRIPTION

Figure 1:
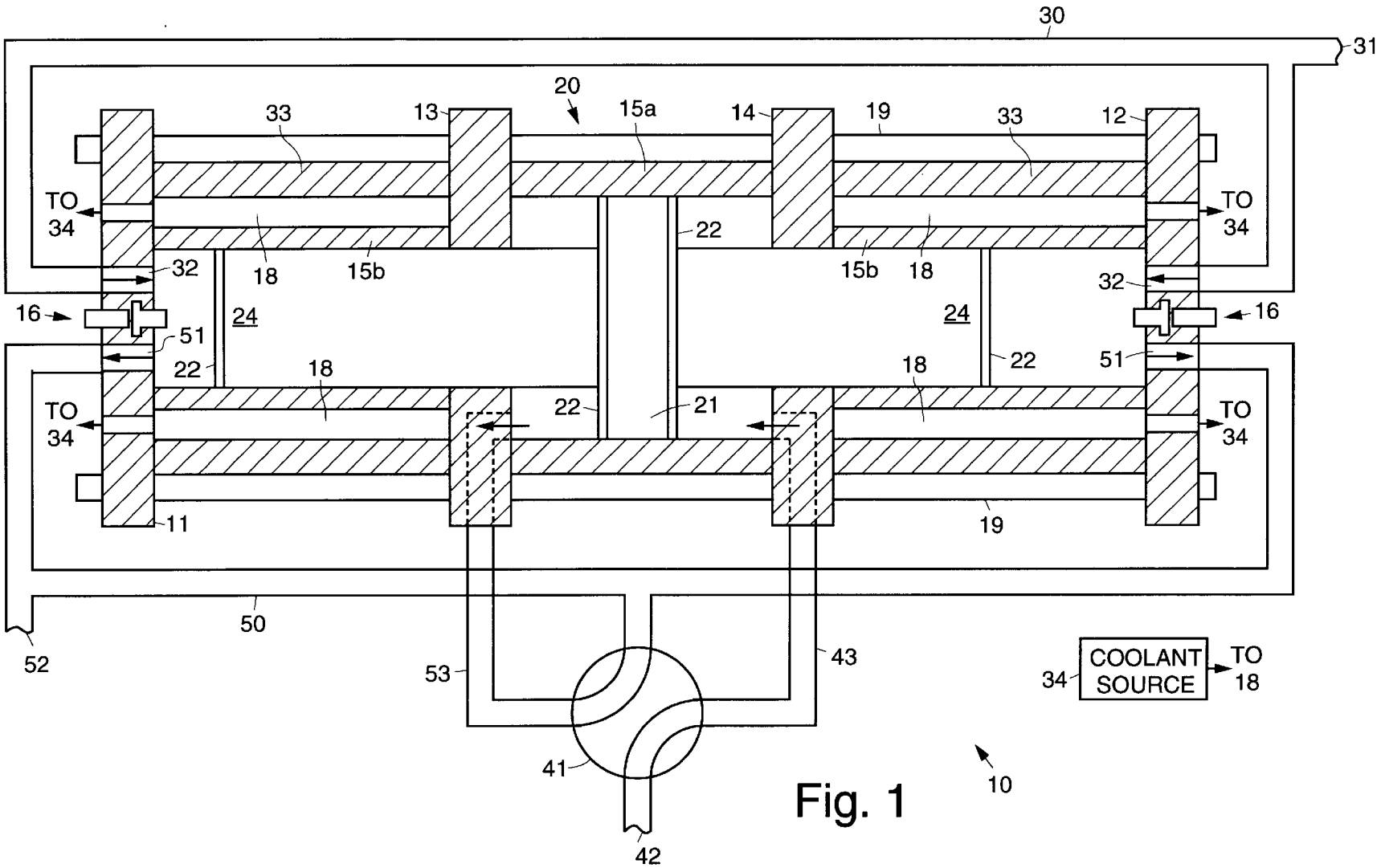

The DryWash™ process is a cleaning system and method that uses liquid carbon dioxide to dry-clean garments. Details of the process can be found in U.S. Pat. No. 5,467,492, for example, assigned to the assignee of the present invention. The process utilizes a high pressure, high flow rate pump that circulates liquid carbon dioxide ($CO_2$) though the system. At the conclusion of a cleaning cycle, the liquid is transferred to a storage tank for reuse. The cleaning chamber however, remains filled with gaseous $CO_2$. Cost and supply logistics dictate that the gaseous $CO_2$ must be recovered prior to opening the vessel door. Hence, a compressor is needed. Various types of compressors are well known and available in the marketplace. However, these compressors are expensive and bulky. They are also subject to leakage at the point where piston rings contact the cylinder wall.

Compressors require a considerable amount of power to operate. Depending on the type of compressor, this power is delivered either from an electric motor, a pneumatic system, or a hydraulic system. All of these options add cost, weight and bulk to the system. In the case of pneumatic or hydraulic systems, the fluid motive power is ultimately supplied by a motor, even if the motor is remotely located.

The present invention tales advantage of the fact that the DryWash™ system includes a high flow rate liquid pump. The operating sequence of the system is such that the pump is not otherwise needed when compression is needed. Therefore, the pump is available for use at that time.

The present invention also takes advantage of the fact that cross-mixing of liquid and gaseous $CO_2$ is not a concern. In the case of hydraulic or pneumatic powered systems, in contrast, mixing of $CO_2$ with hydraulic fluid or air can cause major mechanical failure, or contamination of the respective working fluids.

Because cross-mixing is not a concern, liquid $CO_2$ can be injected directly into the compression cylinder thus providing cooling. With close control of liquid injection, the heating action of gas compression can be completely eliminated. This minimizes constraints on materials selection.

Referring to the sole drawing figure, it illustrates a cross-sectional side view of a compressor 10 in accordance with the principles of the present invention designed for use in liquefied gas applications. The compressor 10 includes a cylinder body 15 comprising a series of cylinders that are separated by plates 11, 12, 13, 14, and held together with tie bolts 19. In particular, the cylinder body 15 comprises a central liquid cylinder 15*a* in axial alignment with two gas cylinders 15*b* disposed on opposite ends thereof.

A piston assembly 20 is disposed within the cylinders 15*a*, 15*b* and comprises a central liquid drive piston 21 and two compression pistons 24 that are free to slide within the respective cylinders 15*a*, 15*b*. Seal rings 22 are disposed at opposite ends of the compression pistons 24 within the respective cylinders 15*a*, 15*b* to minimize leakage between the cylinders 15*a*, 15*b* and provide a low-friction sliding surface. Coolant channels 18 are provided for the gas cylinders 15*b* and are coupled to a coolant source 34, that cool the compression pistons 24 during operation.

A low pressure gas manifold 30 having a low pressure gas inlet 31 is coupled to opposite ends of the piston assembly 20 through gas inlet check valves 32 disposed in the end plates 11, 12. A liquid-gas manifold 50 having a mixed gas-liquid outlet 52 is coupled to opposite ends of the piston assembly 20 through mixed gas-liquid outlet check valves 51 disposed in the end plates 11, 12.

A liquid switching valve 41 is provided that has a first port comprising a high pressure liquid inlet 42, and a second port 43 coupled to an inlet of the central liquid cylinder 15*a* through an intermediate plate 14. The liquid switching valve 41 further comprises a third port 53 coupled to an outlet of the central liquid cylinder 15*a*, and having a fourth port coupled to coupled to the liquid-gas manifold 50. Limit switches 16 are disposed at respective ends of the piston assembly 20 in each end plate 11, 12 that are coupled to the liquid switching valve 41 and cause the switching valve 41 to rotate as a function of movement of the piston assembly 20.

In operation, liquid at high pressure is injected into the right end of the central liquid cylinder 15*a* (as shown in the drawing figure). The pressure on the central liquid drive piston 21 forces the entire piston assembly 20 to slide to the left. Gas within the gas cylinders 15*b* on the left (as shown in the drawing figure) is compressed and exits through the check valve 51. Simultaneously, low pressure gas is drawn into the right end of the gas cylinders 15*b* through the inlet check valve 32 coupled thereto.

Once the piston assembly 20 reaches the left gas cylinder 15*b*, the liquid switching valve 41 rotates one quarter turn. Liquid is then injected into the left side of the central liquid cylinder 15*a*. Liquid on the right side of the central liquid cylinder 15*a* is forced through the liquid switching valve 41 and toward the mixed gas-liquid outlet 52. Gas within the right gas cylinder 15*b* is compressed and flows out the outlet check valve 51 coupled thereto. Once the piston assembly 20 returns to the right gas cylinder 15*b*, the liquid switching valve 41 rotates again, thus completing a full cycle.

During the compression stroke, high temperature is generated within the gas cylinders 15*b*. Therefore, a second, concentric cylinder 33 is disposed around the gas cylinders 15*b* to provide the coolant channels 18. The coolant channels 18 may be conveniently fed with drive cylinder liquid, such as the high pressure liquid $CO_2$. Alternatively, a second cooling fluid such as water may be used.

As an example of the present invention, a compressor 10 was constructed having the following dimensions:

| Component | Size |
|---|---|
| Gas cylinder inside diameter | 2 inches (5.08 cm) |
| Liquid cylinder inside diameter | 3.5 Inches (8.89 cm) |
| Stroke length | 8 inches (20.32 cm) |
| Gas inlet/outlet | 3/8" NPT |
| Liquid inlet/outlet | 1" NPT |
| Minimum gas inlet pressure | 35 psia (241 KPa) |
| Maximum gas outlet pressure | 800 psi (5.52 MPa) |
| Maximum liquid inlet pressure | 1200 psi (8.27 MPa) |

-continued

| Component | Size |
|---|---|
| Maximum liquid outlet pressure | 800 psi (5.52 MPa) |
| Flow rate | 0.66 CFM (18.7 liters per minute) |

Sizing of components for other flow rates and pressures may be determined by a simple force balancing between the liquid pressure, gas pressure and piston areas:

$$\frac{\text{Liquid inlet pressure} - \text{liquid outler pressure}}{\text{Gas outlet pressure} - \text{gas inlet pressure}} = \frac{\text{Gas piston area}}{\text{Liquid piston area}}.$$

Using the example above, the maximum liquid inlet pressure can be calculated:

$$\frac{\text{Liquid inlet pressure} - 800\text{ psi}}{800\text{ psi} - 35\text{ psi}} = \frac{3.14\text{ square inches}}{6.47\text{ square inches}}.$$

Therefore, the required liquid inlet pressure is 1171 psi.

In a similar fashion, the ratio of gas flow to liquid flow rate can be determined:

$$\frac{\text{Gas flow}}{\text{Liquid flow}} = \frac{\text{Liquid piston area}}{\text{Gas piston area}}.$$

Again using the above example, $$\frac{0.66\text{ CFM}}{\text{Liquid flow}} = \frac{3.14\text{ square inches}}{6.47\text{ square inches}}.$$

Therefore, the required liquid flow rate is 1.36 CFM.

In the above application, the dimensions were optimized to provide a high pressure outlet with as low an inlet pressure as possible. Depending on the desired application, other dimensions may be more suitable. For instance, if the intended use only requires a small increase in gas pressure, such as a blower, then the area of the gas piston 24 should be larger than the area of the liquid piston 21. This allows a substantially larger gas flow rate for a given amount of liquid flow. A single compressor 10 can be constructed to accomplish both requirements simultaneously, if provisions are made to switch the liquid and gas inlet ports 42, 31. With the above compressor dimensions and using the same liquid flow, for example, a gas flow rate of 2.8 CFM can be achieved. This would allow gas at 800 psi inlet pressure to be boosted to 1000 psi. Other configurations can easily be achieved, such as configurations for two-stage compression, for example.

Thus, an improved compressor for use in liquefied gas applications has been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A compressor comprising:

a central liquid cylinder;

two gas cylinders disposed adjacent opposite ends of the liquid cylinder that are axially aligned therewith, a piston assembly disposed within the cylinders that comprises a central liquid drive piston and two compression pistons that are free to slide within the respective liquid and gas cylinders;

a low pressure gas manifold coupled to the piston assembly;

a liquid-gas manifold coupled to opposite ends of the piston assembly;

a liquid switching valve having a first port comprising a high pressure liquid inlet, a second port coupled to an inlet of the central liquid cylinder, a third port coupled to an outlet of the central liquid cylinder, and a fourth port coupled to the liquid-gas manifold; and limit switches disposed at opposite ends of the piston assembly that are coupled to the liquid switching valve and cause the switching valve to rotate as a function of movement of the piston assembly.

2. The compressor of claim 1 further comprising:

seal rings disposed at opposite ends of the compression pistons and liquid drive piston within the respective liquid and gas cylinders.

3. The compressor of claim 1 further comprising:

coolant channels disposed around the gas cylinders and that are coupled to a coolant source for minimizing leakage between the cylinders and providing a low-friction sliding surface.

4. The compressor of claim 1 further comprising:

gas inlet check valves coupled between the low pressure gas manifold and opposite ends of the compression cylinder assembly.

5. The compressor of claim 1 further comprising:

mixed gas-liquid outlet check valves coupled between the liquid-gas manifold and opposite ends of the compression cylinder assembly.

6. The compressor of claim 1 wherein the central liquid cylinder and gas cylinders are separated by plates, and held together with tie bolts.

7. The compressor of claim 3 wherein the coolant source comprises a water source.

8. The compressor of claim 3 wherein the coolant source comprises drive cylinder liquid source.

9. A compressor for use in liquefied gas applications, comprising:

a central liquid cylinder;

two gas cylinders disposed adjacent opposite ends of the liquid cylinder that are axially aligned therewith;

a piston assembly disposed within the cylinders that comprises a central liquid drive piston and two compression pistons that are free to slide within the respective liquid and gas cylinders;

seal rings disposed at opposite ends of the compression pistons and liquid drive piston within the respective liquid and gas cylinders;

coolant channels disposed around the gas cylinders and that are coupled to a coolant source;

a low pressure gas manifold coupled to opposite ends of the piston assembly through gas inlet check valves;

a liquid-gas manifold having a mixed gas-liquid outlet, which manifold is coupled to opposite ends of the piston assembly through mixed gas-liquid outlet check valves;

a liquid switching valve having a first port comprising a high pressure liquid inlet, a second port coupled to an inlet of the central liquid cylinder, and a third port coupled to an outlet of the central liquid cylinder, and a fourth port coupled to the liquid-gas manifold; and limit switches disposed at opposite ends of the piston assembly that are coupled to the liquid switching valve and cause the switching valve to rotate as a function of movement of the piston assembly.

10. The compressor of claim 9 wherein the central liquid cylinder and gas cylinders are separated by plates, and held together with tie bolts.

11. The compressor of claim 9 wherein the coolant source comprises a water source.

12. The compressor of claim 9 wherein the coolant source comprises drive cylinder liquid source.

* * * * *